United States Patent [19]

Hansel

[11] 3,996,977

[45] Dec. 14, 1976

[54] AUTOMATIC DISPENSING NOZZLE ADAPTED FOR VAPOR RECOVERY

[75] Inventor: William B. Hansel, Media, Pa.

[73] Assignee: Sun Oil Company of Pennsylvania, Philadelphia, Pa.

[22] Filed: Aug. 11, 1975

[21] Appl. No.: 603,824

Related U.S. Application Data

[63] Continuation-in-part of Ser. No. 468,841, May 10, 1974, Pat. No. 3,946,773.

[52] U.S. Cl. ..... 141/285; 138/42; 141/392

[51] Int. Cl.[2] ..... B65B 3/18

[58] Field of Search ..... 141/1, 46, 52, 59, 93, 141/97, 128, 198, 206–229, 285, 290, 392; 138/42

[56] References Cited

UNITED STATES PATENTS 3,899,009 8/1975 Taylor ..... 141/59

FOREIGN PATENTS OR APPLICATIONS 1,292,909 2/1958 France ..... 141/392

*Primary Examiner*—Richard E. Aegerter
*Assistant Examiner*—Frederick R. Schmidt
*Attorney, Agent, or Firm*—J. Edward Hess; Donald R. Johnson; William C. Roch

[57] ABSTRACT

In order to prevent malfunctioning of an automatic liquid fuel dispensing nozzle which is being used for vapor recovery while dispensing, the pressure inside the tank (into which liquid fuel is being dispensed) is used as a reference pressure for the actuating diaphragm of the nozzle cut-off arrangement, rather than using atmospheric pressure for this purpose. Displaced vapors from the tank are directed through a vapor recovery boot having a flexible, exterior cylindrical sleeve and an interior of reticulated material which provides passageways for the vapors to travel through.

3 Claims, 4 Drawing Figures

AUTOMATIC DISPENSING NOZZLE ADAPTED FOR VAPOR RECOVERY

This application is a continuation-in-part of application Ser. No. 468,841, filed May 10, 1974 for Automatic Dispensing Nozzle Adapted for Vapor Recovery, now U.S. Pat. No. 3,946,773.

This invention relates to dispensing nozzles of the type commonly used at service stations for dispensing liquid fuel into the fuel tanks of motor vehicles.

So-called automatic dispensing nozzles have been developed for the dispensing of liquid fuel. Typical nozzles of this type are disclosed in U.S. Pat. No. 2,582,195 and in U.S. Pat. No. 2,528,747. Such nozzles include automatic shut-off mechanisms that terminate the liquid fuel flow when the open end of an air duct at the discharge end of the nozzle is blocked by the rising liquid level in the tank being filled. Blocking of the air duct creates an increased vacuum inside a chamber which causes a flexible pressure-responsive diaphragm (the front side of which is coupled to the chamber and the back side of which is coupled to atmospheric pressure) to trip the nozzle valve, whereby liquid flow through the nozzle is terminated.

For the reduction of air pollution, as well as for other purposes, it is desirable to collect and recover the vapors which are displaced from the liquid fuel tanks of motor vehicles when fuel is dispensed thereinto. In order to collect and recover these vapors, there have been developed several vapor collection devices for liquid fuel (e.g., gasoline) dispensing nozzles, which sealingly couple the nozzle to the fillpipe of the motor vehicle fuel tank (into which the fuel is being dispensed); these collection devices also provide a passage for vapors displaced from the tank, so such vapors can be directed to a recovery system.

Tests on automatic nozzles of the aforementioned type, when used with vapor collection devices, have revealed a frequent malfunction, which is that the nozzle will not shut off properly. Such malfunction occurs when a liquid slug blocks the fuel tank fillpipe, or when there is a blockage (or restriction) in the vapor return line (which is coupled to the vapor passage in the collection device). When one of these conditions fortuitously occurs, pressure is built up in the vehicle fuel tank, and this is reflected on the front side of the diaphragm (by way of the air duct), thus holding the (automatic) quick-release mechanism in "valve open" (i.e., "on") position. The nozzle cut-off response time then being very slow or even non-existent, shut-off occurs only after liquid fuel has been pushed out around the seal, onto the service station driveway, and upward into the vapor return line. This type of nozzle malfunctioning defeats the main purpose of vapor recovery (which is the reduction of air pollution).

Also, some dispensing nozzles designed to have a vapor recovery capability, such as that illustrated in U.S. Pat. No. Re. 28,294, have a flexible bellows around the nozzle to provide a return path for vapors displaced from the gasoline tank. One disadvantage encountered with a bellows design is that liquid gasoline which has been backed up into the bellows and also vapors which have condensed tend to collect in the bottom of the spirals of the bellows and do not empty back into the tank. The trapped gasoline often resulted in gasoline spilled onto the ground when the nozzle was tilted downward. The spilled gasoline is a source of pollution, which somewhat defeats the overall purpose of a vapor recovery system.

An object of this invention is to provide an improved automatic dispensing nozzle.

Another object is to provide an automatic nozzle which is particularly useful for vapor-recovery dispensing.

A further object is to provide an automatic nozzle construction which prevents malfunctioning in a vapor recovery dispensing situation.

A still further object is to adapt an automatic dispensing nozzle to a vapor recovery dispensing situation.

Another object of this invention is a nozzle having an improved vapor recovery boot which provides a return path for displaced gasoline vapors, but which does not have the disadvantages of the prior art bellows design, and does not result in excessive spillage of gasoline from the nozzle.

The objects of this invention are accomplished, briefly, in the following manner: In an automatic nozzle used for vapor recovery, the back side of the pressure-responsive diaphragm is vented to the pressure in the motor vehicle fuel tank, by means of a passage or conduit coupling the vapor return line to such back side. Also, a seal is placed around the plunger of the quick-release mechanism of the nozzle, to seal off the diaphragm back side from the atmosphere.

A detailed description of the invention follows, taken in conjunction with the accompanying drawings, wherein.

Figure 1:
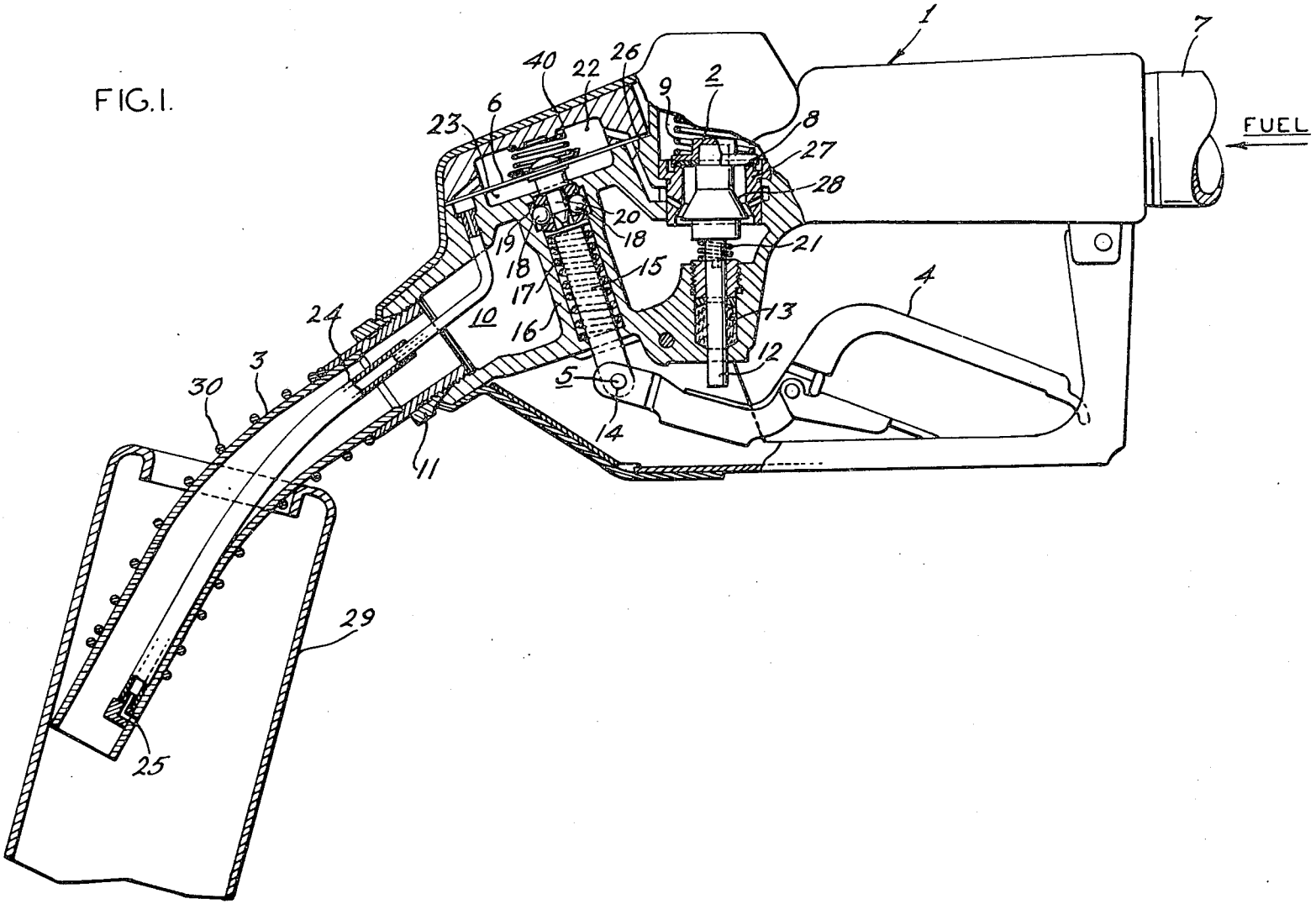
FIG. 1 is a view in partial longitudinal section of a standard or conventional automatic dispensing nozzle, illustrated in a dispensing situation.

Referring first to FIG. 1, which illustrates a typical automatic dispensing nozzle used for conventional (i.e., non-vapor-collecting) dispensing, the dispensing nozzle comprises a body 1 having a normally closed main valve 2 therein, a spout 3, a valve handle or lever 4 provided with a fulcrum 5, and a pressure-responsive diaphragm 6. With any quantity of liquid flowing through the nozzle, the diaphragm 6 operates mechanism which is arranged to trip or release the fulcrum 5 to a position wherein main valve 2 automatically closes, when the discharge end of the spout 3 is submerged in a liquid to a predetermined depth. The body 1 is provided with an inlet passageway (not shown), communicating with a supply hose 7, which passageway leads to a valve seat 8 on which main valve 2 is normally pressed or seated by a main spring 9. When the main valve is open, the inlet passageway mentioned communicates with an outlet passageway 10 which, in turn, is connected to the discharge spout 3. The tubular spout 3 is threaded into body 1 and is secured by a lock nut 11.

The main valve 2 is provided with a valve stem 12 which extends downwardly and outwardly of body 1 through a packing gland 13. The lower end of the stem 12 is disposed to be engaged by hand lever 4 when the lever is actuated upwardly, to lift valve 2 off its seat 8 against the force of spring 9.

Fulcrum 5 comprises a pin 14 on which the lever 4 is pivotally mounted. The pin is supported by a clevis or yoke (not specifically shown, but between the arms of which the pivoted end of lever 4 is disposed) which is attached to the lower end of a plunger 15. Plunger 15 is slidably disposed in a housing or sleeve 16 which is integral with the valve body 1. Plunger 15 is urged upwardly by a coil spring 17 as shown. It is urged downwardly by spring 9 as will be explained later.

Normally, the plunger 15 is held in a fixed position by a locking mechanism comprising a plurality of balls 18 nested in radial openings (not shown) in the plunger and an annular shoulder 19 on the interior of sleeve 16. The balls are held on shoulder 19, as shown, by a pin 20 secured to the back side of the diaphragm 6. Pin 20 is provided with a tapered portion at a location slightly below the balls. Thus, when the pin is raised to a position wherein the tapered portion is adjacent the balls, plunger 15 will be actuated downwardly, provided hand lever 4 is in its valve opening position. This movement of the plunger results because of the strong force of spring 9 and the relatively weaker forces of spring 17 and of spring 21, which latter urges the valve 2 toward its open position. When plunger 15 moves downwardly, fulcrum 5 is moved downwardly to a position such that the valve stem 12 is disengaged from hand lever 4.

As shown somewhat schematically in FIG. 1 (this construction is illustrated in detail, for example, in the U.S. Pat. No. 2,582,195, previously mentioned), the movable, flexible, pressure-responsive diaphragm 6 (which is clamped at its marginal edges) forms a partition between two chambers 22 and 23 which are provided in body 1; thus, the diaphragm comprises one wall of the first chamber 22 and also one wall of the second chamber 23. The chamber 22 on the front side of the diaphragm comprises a suction chamber, while the chamber 23 on the back side of the diaphragm comprises a reference chamber.

Chamber 22 communicates with a tube 24 the open end of which is at 25 adjacent the discharge end of the spout 3. Opening or inlet 25 extends through the side wall of the spout and is removed from the flow stream through such spout. Diaphragm chamber 22 also communicates with the flow passageway 10 adjacent and immediately below valve 2, through a passageway 26. The flow passageway of the nozzle is designed to provide a Venturi effect on the diaphragm 6. A ring 27 is mounted in the passageway 10 below the valve seat 8, and this ring cooperates with a frusto-conical element 28 secured to stem 12 to provide a converged or restricted throat. Immediately below this throat is an annular groove to which passageway 26 is connected.

Due to leakage around the plunger 15, the reference pressure in the second chamber 23 (back side of diaphragm 6, and which pressure may be denoted by $P_{BD}$) is the atmospheric pressure, $P_A$.

When it is desired to fill a motor vehicle fuel tank, the nozzle spout 3 is placed in the fillpipe 29 of the tank, as illustrated in FIG. 1. A retention spring 30 is preferably mounted about the spout 3 in a conventional manner, to provide friction for holding the spout in the fillpipe 29, and also to assist in making electrical contact with the fillpipe (or fuel tank) and the nozzle body.

Assuming that the fulcrum 5 is in its locked position (illustrated in FIG. 1) and that is is desired to dispense liquid fuel (gasoline) into the fillpipe 29, the nozzle is placed as shown. The operator then lifts the valve handle 4; since the fulcrum 5 is held in fixed position, valve stem 12 will be lifted and main valve 2 opened. This results in the flow of fuel through passageway 10.

When fuel is flowing through the passageway 10, a low pressure is created at the Venturi or power unit 27, 28, so that vapor-containing air flows into inlet 25, then through the tube 24 and chamber 22 into the Venturi or power unit (by way of passageway 26).

when liquid rises in the fuel tank sufficiently to cover over the inlet 25, a low pressure $P_{FD}$ (less than atmospheric pressure) is established in the chamber 22 of the front side of the diaphragm 6. Atmospheric pressure on the back side of the diaphragm ($P_{BD}$ being equal to $P_A$, in this case) then deflects the diaphragm 6 upwardly (this deflection being the result of the pressure differential between chambers 22 and 23). This upward deflection of diaphragm 6 raises pin 20, triggering the quick release mechanism for the fulcrum 5. Plunger 15 is actuated downwardly, moving the fulcrum downwardly and closing the main valve 2 to stop the fluid flow. Diaphragm 6 is moved upwardly, in the above-described manner, against the force of spring 40.

As its opposite (or lower) end, the sleeve 32 is sealed to the outer diameter of a ring-like arrangement 34 which includes a magnetic material; thus, the arrangement 34 can act like a permanent magnet, to hold (by means of magnetic attractive force) and seal the lower end of sleeve 32 to the upper end of the ferromagnetic fillpipe 29.

Figures 3, 4:
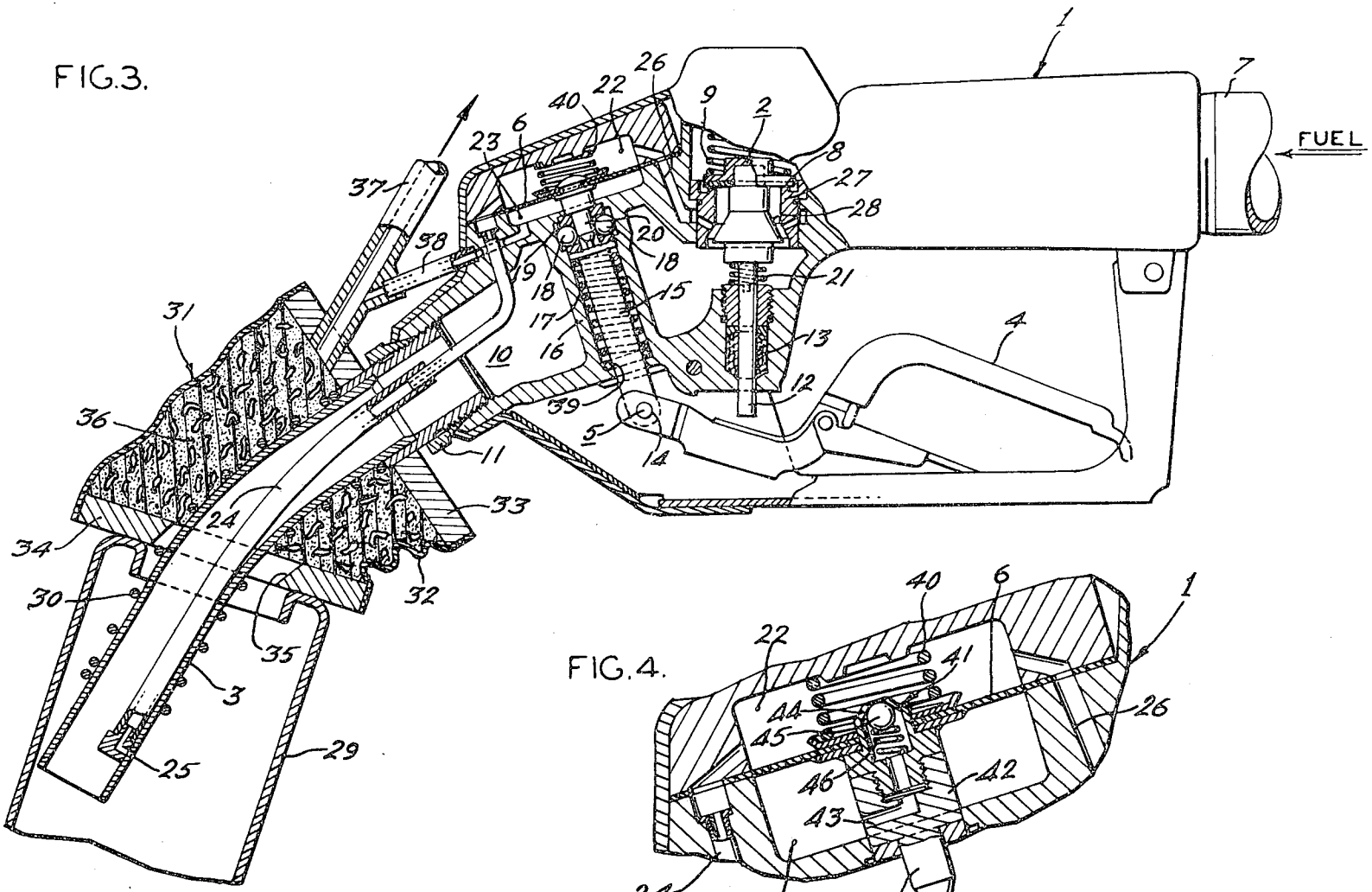
FIG. 3 is a view in longitudinal section of an automatic dispensing nozzle adapted for vapor recovery according to this invention.
FIG. 4 is a schematic view of a modified form of pressure balancing arrangement.

The ring 34 has therein an aperture 35 which surrounds and is spaced from the outside of spout 3, thereby to provide an annular passage through which vapors displaced from the motor vehicle fuel tank (and flowing upwardly in fillpipe 29) can enter the space inside sleeve 32. A body 36 of a reticulated foamed material, which contains therein a multiplicity of tortuous, interconnected passages, is positioned within the sleeve 32. The body 36 serves to freely convey or transmit the vapors which pass through the aperture 35 (at the bottom of such body), to the upper end of sleeve 32. The cylindrical sleeve 32 is made of a soft flexible material. This eliminates the ridged bottom of the prior art bellows design, and results in less trapping of liquids in the bottom ridges and consequently less spillage of gasoline from the nozzle. Although FIG. 3 illustrates the sleeve as being bent along the bottom when the magnetic seal is broken and the nozzle is withdrawn from the fillpipe, the sleeve 32 will tend to straighten out to a cylindrical shape. The reticulated material 36 freely transmits vapors through the sleeve, and also prevents the cylindrical sleeve 32 from ballooning when pressure builds up within the vapor recovery system. For this purpose, the cylindrical boot 31 may be secured directly to the reticulated foam material. A conduit 37, which provides a continuation, from the interior of sleeve 32, of the passage for vapors displaced from the tank, is coupled at one end to the upper end of body 36. Conduit 37 leads to a suitable vapor recovery system (not shown). Thus, vapors displaced from the motor vehicle fuel tank when liquid fuel (such as gasoline) is dispensed thereinto flow upwardly through fillpipe 29, then through opening 35 and the body 36 into the conduit 37, and then through this conduit to the recovery system.

Figure 2:
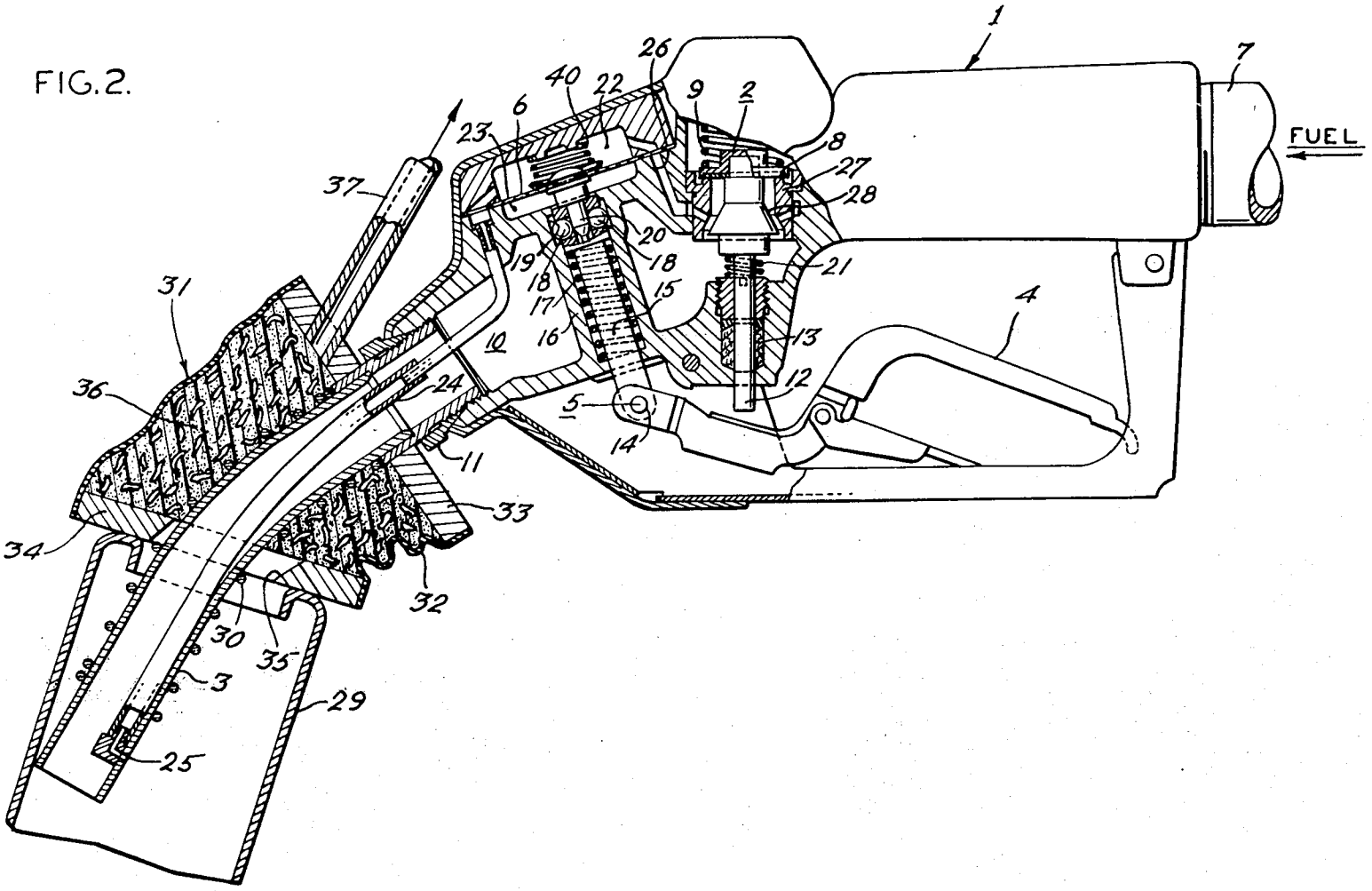
FIG. 2 is a view generally similar to FIG. 1, but wherein the nozzle is used in a vapor recover situation.

In the vapor recovery situation of FIG. 2, the pressure $P_T$ in the fuel tank (or in the fillpipe 29) is reflected onto the front side of the diaphragm 6, by way of the tube 24.

When there is a sudden pressure buildup in the system resulting from a blockage in the vapor return line 37, or from a liquid slug or spit back in the fillpipe 29, the pressure $P_T$ increases, to above atmospheric pressure $P_A$. This pressure increase or buildup can easily, and often does, happen during vapor-recovery dispensing. Under these conditions, the pressure $P_{FD}$ on the front side of the diaphragm (which is substantially equal to $P_T$) is greater than $P_A$.

When the pressure $P_T$ thus goes above atmospheric, the pressure differential across the power unit 27, 28 decreases; when this pressure differential is reduced, the power unit or Venturi does not create its normal vacuum (since its ability to generate power is then decreased).

The combination of above-atmospheric pressure on the front side of the diaphragm (which would mean a longer time requirement for the power unit to pull down the $P_{FD}$ below atmospheric) and the reduction in the ability of the power unit to generate power means that, when fuel covers the air inlet 25, the nozzle cut-off response time is very slow, or even non-existing. This time lag allows fuel to be pushed out around the seal at 34, and also up into the vapor return line 37. These results are undesirable, and it is the purpose of this invention to prevent this malfunctioning of the automatic dispensing nozzle, vapor-recovery arrangement illustrated in FIG. 2.

Refer now to FIG. 3, wherein, again, parts the same as those previsouly described are denoted by the same reference numerals. According to this invention, the back side of the diaphragm 6 is vented to the tank pressure $P_T$; this is done in FIG. 3 by connecting a pressure balance line or conduit 38 from the reference chamber 23 (back side of diaphragm) to the conduit 37 (the pressure in this latter conduit being substantially equal to the tank pressure $P_T$).

In order to use the tank pressure $P_T$ as a reference for the diaphragm 6, rather than atmospheric pressure, a seal 39 (typically in the form of an O-ring) is provided around the plunger 15, to seal off the internal part of this plunger (and hence also the reference chamber 23) from the atmosphere.

With the FIG. 3 construction, if the tank pressure $P_T$ builds up for any reason, the pressure on both sides of the diaphragm goes up. Hence, $P_{FD}$ is substantially equal to $P_{BD}$ and also to $P_T$, and these are all above $P_A$. But, the pressure differential across the diaphragm (which is developed when the fuel tank becomes full) is about the same as under normal operation.

When liquid covers the inlet 25, the power unit 27, 28 lowers $P_{FD}$ below $P_{BD}$, so the tank pressure $P_T$ on the back side of the diaphragm 6 pushes up the diaphragm quickly, and makes the automatic shut-off arrangement operate normally. That is to say, the tank pressure on the back side of the diaphragm now does the pushing, rather than atmospheric pressure. The shut-off mechanism of FIG. 3 operates in as sensitive a manner as does that of FIG. 1, and this regardless of the pressure in the system. The results are no spit back of fuel and no spillage.

Summarizing the foregoing, the automatic nozzle of FIGS. 1 and 2 is an atmospheric nozzle; to prevent malfunctioning when such automatic nozzle is used for vapor recovery, it must operate with tank pressure as its reference (as in FIG. 3), rather than atmospheric pressure.

Refer now to FIG. 4, which discloses a different arrangement (perhaps a more practical arrangement than that disclosed in FIG. 3) for venting the back side of the diaphragm 6 to the tank pressure $P_T$ (that is, for using the tank pressure as the reference in the chamber 23). In brief, the FIG. 4 construction comprises a one-way check valve, denoted generally by numeral 41, which is mounted in the diaphragm spindle 42 which secures the pin 20 to the back side of diaphragm 6. The flow direction of the check valve 41 is from the suction chamber 22 to the reference chamber 23.

Spindle 42 has therein an internal channel 43 one end of which opens into the back side chamber 23 and the opposite end of which opens through a frusto-conical valve seat 44 into the front side chamber 22. A spring-loaded ball 45 is pressed against the seat 44, the operation being such that when the pressure in chamber 22 is slightly higher than the pressure in chamber 23, the force of the spring 46 is overcome and ball 45 is pushed away from its seat 44, thus opening the valve 41 and placing chamber 23 in communication with chamber 22. When the pressure in chamber 23 exceeds the pressure in chamber 22, ball 45 is pushed against its seat, closing valve 41.

In FIG. 4, the tube 24 communicates the tank pressure $P_T$ to the front side of the diaphragm (chamber 22); when this pressure goes up (e.g., about $P_A$) the check valve 41 opens; so that the tank pressure $P_T$ is also communicated to the back side of the diaphragm (chamber 23). In FIG. 4, then $P_{FD}$ is substantially equal to $P_{BD}$ and to the tank pressure $P_T$, these all being above $P_A$ (atmospheric pressure). Thus, in FIG. 4, just as in FIG. 3, the back side of the diaphragm 6 is again vented to the tank pressure $P_T$, when the latter increases above atmospheric pressure.

In FIG. 4, just as in FIG. 3, when liquid covers the inlet 25, the pressure $P_{FD}$ (in chamber 22) is decreased below $P_{BD}$ (in chamber 23), so that the diaphragm 6 is again pushed up quickly. Under these conditions (pressure in chamber 23 higher than than in chamber 22), the valve 41 remains closed, so does not interfere with the automatic shut-off operation.

I claim:

1. A liquid dispensing nozzle adapted for recovery of gasoline vapors displaced from a fuel tank being filled by the nozzle and comprising:

a. a discharge spout for insertion into a fillpipe for a motor vehicle fuel tank;

b. a vapor recovery boot surrounding the discharge spout and providing a passage for gasoline vapors displaced from a fuel tank, said boot being formed of a flat piece of flexible material wrapped around the discharge spout in a substantially cylindrical shape to provide a smooth, flat interior which will not trap condensed vapors or gasoline backed up into the boot, and a reticulated material filling the space between said discharge spout and said substantially cylindrically shaped flexible material and being secured to said substantially cylindrically shaped flexible material to prevent the flexible material from ballooning as a result of a build up of pressure of the displaced vapors, said reticulated material having a multiplicity of interconnected passages to allow the passage therethrough of displaced gasoline vapors.

2. A nozzle as set forth in claim 1 and including a magnetic seal attached to one end of said substantially cylindrically shaped material.

3. A nozzle as set forth in claim 2 and including a vapor return line attached to the other end of said substantially cylindrically shaped material.

* * * * *